US008955213B2

(12) United States Patent
Gordon et al.

(10) Patent No.: US 8,955,213 B2
(45) Date of Patent: Feb. 17, 2015

(54) APPARATUS AND KIT FOR STUFFING PLUSH TOYS AND METHOD THEREOF

(75) Inventors: Todd Gordon, Shoreham, NY (US); Frank Bartleucci, Manahawkin, NJ (US)

(73) Assignee: Lionfish Development, LLC, Hauppauge, NY (US)

( * ) Notice: Subject to any disclaimer, the term of this patent is extended or adjusted under 35 U.S.C. 154(b) by 266 days.

(21) Appl. No.: 13/431,546

(22) Filed: Mar. 27, 2012

(65) Prior Publication Data

US 2012/0304442 A1 Dec. 6, 2012

Related U.S. Application Data

(60) Provisional application No. 61/519,988, filed on Jun. 3, 2011.

(51) Int. Cl.

| | |
|---|---|
| ***A22C 11/00*** | (2006.01) |
| ***A63H 3/02*** | (2006.01) |
| ***A63H 9/00*** | (2006.01) |

(52) U.S. Cl.

CPC ... *A63H 9/00* (2013.01); *A63H 3/02* (2013.01)
USPC ..... 29/700; 29/428; 446/369; 446/73

(58) Field of Classification Search

USPC ..... 29/428, 700; 446/369, 71–73, 385, 386; 53/469

See application file for complete search history.

(56) References Cited

U.S. PATENT DOCUMENTS

| | | | | |
|---|---|---|---|---|
| 655,822 | A * | 8/1900 | Clements | 241/101.5 |
| 2,377,069 | A * | 5/1945 | Brubaker | 99/494 |
| 2,572,917 | A * | 10/1951 | Ell | 452/44 |
| 2,816,407 | A * | 12/1957 | Brockmann | 53/469 |
| D427,209 | S * | 6/2000 | Collida et al. | D15/66 |
| 6,109,196 | A * | 8/2000 | Silber | 112/475.08 |
| 6,527,617 | B1 * | 3/2003 | Capozzi et al. | 446/369 |
| 6,547,633 | B2 * | 4/2003 | Haug | 446/369 |
| 6,685,532 | B1 * | 2/2004 | McLean | 446/369 |
| D490,089 | S * | 5/2004 | Box et al. | D15/66 |
| 6,860,092 | B2 * | 3/2005 | Collida et al. | 53/521 |
| 6,932,668 | B2 * | 8/2005 | Digby et al. | 446/369 |
| D549,256 | S * | 8/2007 | Bartleucci et al. | D15/145 |
| 7,377,841 | B2 * | 5/2008 | Bartleucci et al. | 452/30 |
| 2004/0259464 | A1 * | 12/2004 | Lien et al. | 446/268 |
| 2006/0128264 | A1 * | 6/2006 | Tang | 446/369 |
| 2008/0166944 | A1 * | 7/2008 | Nelson | 446/129 |
| 2012/0180435 | A1 * | 7/2012 | Stelluti | 53/469 |

FOREIGN PATENT DOCUMENTS

WO WO 2004094017 A2 * 11/2004

* cited by examiner

*Primary Examiner* — David Bryant
*Assistant Examiner* — Jason L Vaughan
(74) *Attorney, Agent, or Firm* — Mark R. Malek; Widerman Malek, PL

(57) ABSTRACT

An apparatus and kit for stuffing plush toys and a method of stuffing using the device. The apparatus including a stuffing hopper with an inlet for receiving stuffing, an auger housing located below and in communication with the stuffing hopper, a device located in the stuffing hopper for feeding stuffing from the stuffing hopper into the auger housing and a rotatable auger located within the auger housing to feed stuffing out of the apparatus and into a plush toy casing.

17 Claims, 8 Drawing Sheets

APPARATUS AND KIT FOR STUFFING PLUSH TOYS AND METHOD THEREOF

CROSS-REFERENCE TO RELATED APPLICATION

This application claims benefit from U.S. Provisional Patent Application Ser. No. 61/519,988, filed Jun. 3, 2011, the contents of which are hereby incorporated by reference.

BACKGROUND OF THE INVENTION

1. Field of the Invention

The present invention is directed to the field of stuffed toys, in particular, a method, apparatus and kit for stuffing plush toys.

2. Description of the Related Art

Retail shops at which customers can make customized stuffed toys such as teddy bears are extremely popular. Such toys are also known in the toy trade as "plush." At such retail shops customers choose from a variety of pre-made animal or character "skins," which are the outer fabric casings of the plush toy comprised of fabric panels sewn together into the form of the animal or character and act as the container, which is formed into the full shape of the animal or character by being stuffed full of a soft, fluffy stuffing material. In essence, the skin is the plush toy absent the stuffing and decorative detailing. The customer also selects from a variety of facial features to be attached to the skin in the appropriate location after the skin is stuffed and choose from a variety of clothing and other accessories to complete the plush toy.

The focal point of the in-store manufacturing process is the stuffing machine. It is a large piece of heavy equipment that typically measures several feet in length, width, and height, and weighs hundreds of pounds. It is powered by a/c current that runs large motors, blowers and air compressors which, together, generate and direct significant air velocity and pressure needed to feed the stuffing from the machine, through an injection tube, and into the skin through a hole in the fabric of the skin. Once filled with stuffing, the skin is removed from the injection tube and the store employee closes the skin fill hole by tying shut laces around the hole, or by some other method of closure, which requires the skill of the store employees.

Due to the size and costs of the machine required for this method of stuffing a plush toy, it is too dangerous to be handled by customers, especially young children. Therefore, the customer merely passively watches, while the employee performs the entire manufacturing process.

Attempts have been made to reduce the size and cost of these stuffing machines to make them more portable and more suitable for the mass market, but the degree to which they can be reduced is restricted by the requirements of the large motors and compressors needed to generate sufficient pressure to fill the skins. Such machines also require skill and dexterity not possessed by young children.

There remained a need for a toy stuffing apparatus to be reduced to a size, price, and level of skill and safety that would allow them to be used at home by small children as an activity toy, or craft kit. The inventors' prior U.S. Pat. No. 7,377,841, the contents of which are hereby incorporated by reference, sets forth a mechanical apparatus for stuffing plush toys which can be used at home. This patent includes an apparatus having a top drum within which arms and paddles are rotated to fluff the plush toy stuffing and push the stuffing down into a chamber in which a simultaneously rotated auger, transports the stuffing along the auger shaft and out to an exit, and, in turn into the plush toy casing.

However, this apparatus has numerous parts and their configuration requires a certain size and internal volume to operate properly. Accordingly, there remained a need to have a simpler mechanical toy stuffing apparatus which has less parts and is smaller than the prior art apparatus and, therefore, easier and less expensive to manufacture. There also remained a need to have a mechanical toy stuffing apparatus that was simpler and easier to operate and eliminated the need to hold the plush casing onto the fill nozzle.

The prior art discloses different types of stuffing apparatus. However, so far as is known, none of the prior art devices resolve all of these problems in a simple, effective and yet highly advantageous manner as in the present invention discussed herein.

SUMMARY OF THE INVENTION

It is therefore an object of the invention to provide a novel toy stuffing apparatus.

It is also an object of the invention to provide a toy stuffing apparatus which is simpler and easier to use.

It is a further object of the invention to provide a toy stuffing apparatus wherein the user does not have to hold the stuffed toy casing on the end thereof, when stuffing.

It is yet another object of the invention to provide a toy stuffing apparatus which is simple, easy and inexpensive to manufacture and is comprised of fewer parts than the prior art devices.

Certain of the foregoing and related objects are readily attained according to the present invention by the provision of an apparatus for inserting stuffing into a casing, comprising a stuffing hopper defining an interior chamber therein, having an inlet for receiving stuffing and an outlet for discharging stuffing; an auger housing located below said stuffing hopper and defining an interior chamber therein, which is in communication with said interior chamber of said stuffing hopper, said auger housing having an inlet located adjacent to and in communication with said outlet of said stuffing hopper, and a discharge outlet to discharge the stuffing from said apparatus; means for feeding stuffing from said interior chamber of said stuffing hopper into said interior chamber of said auger housing, which means are located within said stuffing hopper; a rotatable auger located within said interior chamber of said auger housing to drive the stuffing in said interior chamber of said auger housing towards and to said discharge outlet thereof, where it, in turn, exits said auger housing into the casing; and drive means for rotating said auger.

Preferably, the apparatus further comprises an externally threaded nozzle connected to said auger housing adjacent said discharge outlet. In a preferred embodiment, said means for feeding stuffing from said interior chamber of said stuffing hopper into said interior chamber of said auger housing is a resilient bellows movable between a compressed configuration and an expanded configuration, received within said interior chamber of said stuffing hopper. It is also preferable that at least one of said stuffing hopper and said auger housing includes a transparent portion. In one embodiment, said stuffing hopper is transparent. Advantageously, the apparatus further comprises at least one transparent window in said auger housing.

It is preferred that the apparatus further comprises a removable lid receivable over said inlet of said stuffing hopper. Advantageously, said drive means is a manually-operable handle.

Certain of the foregoing and related objects are also readily attained according to the present invention by the provision of a kit for making a stuffed toy at home, comprising a casing having an opening therein; stuffing to be inserted into said casing; closure means for closing said opening in said casing; and an apparatus for inserting stuffing into said casing, comprising a stuffing hopper defining an interior chamber therein, having an inlet for receiving said stuffing and an outlet for discharging said stuffing; an auger housing located below said stuffing hopper and defining an interior chamber therein, which is in communication with said interior chamber of said stuffing hopper, said auger housing having an inlet located adjacent to and in communication with said outlet of said stuffing hopper, and a discharge outlet to discharge said stuffing from said apparatus; means for feeding said stuffing from said interior chamber of said stuffing hopper into said interior chamber of said auger housing, which means are located within said stuffing hopper; a rotatable auger located within said interior chamber of said auger housing to drive said stuffing in said interior chamber of said auger housing towards and to said discharge outlet thereof, where it in turn, exits said auger housing into said casing and drive means for rotating said auger.

Preferably, the apparatus further comprises an externally threaded nozzle connected to said auger housing adjacent said discharge outlet. Advantageously, said means for feeding stuffing from said interior chamber of said stuffing hopper into said interior chamber of said auger housing is a resilient bellows movable between a compressed configuration and an expanded configuration, received within said interior chamber of said stuffing hopper. It is preferable that at least one of said stuffing hopper and said auger housing includes a transparent portion. It is also preferred that a removable lid is receivable over said inlet of said stuffing hopper. Desirably, said drive means is a manually-operable handle.

In addition, certain of the foregoing and related objects are also readily attained according to the present invention by the provision of a method for making a stuffed toy comprising a casing having an opening therein, stuffing to be inserted into said casing, closure means for closing said opening in said casing and an apparatus for inserting stuffing into said casing, comprising a stuffing hopper defining an interior chamber therein, having with an inlet for receiving said stuffing and an outlet for discharging said stuffing; an auger housing located below said stuffing hopper and defining an interior chamber therein, which is in communication with said interior chamber of said stuffing hopper, said auger housing having an inlet located adjacent to and in communication with said outlet of said stuffing hopper, and a discharge outlet to discharge said stuffing from said apparatus; means for feeding said stuffing from said interior chamber of said stuffing hopper into said interior chamber of said auger housing, which means are located within said stuffing hopper; a rotatable auger located within said interior chamber of said auger housing to drive said stuffing in said interior chamber of said auger housing towards and to said discharge outlet, thereof, where it in turn, exits said auger housing into said casing; and drive means for rotating said auger; removing said means for feeding said stuffing from said interior chamber of said stuffing hopper into said interior chamber of said auger housing, from said stuffing hopper; inserting said stuffing into said interior chamber of said stuffing hopper; placing said means for feeding said stuffing from said interior chamber of said stuffing hopper into said interior chamber of said auger housing into said stuffing housing; affixing said opening of casing onto said discharge outlet of said auger housing; rotating said drive means to, in turn, rotate said auger, to feed said stuffing from said interior chamber of said stuffing hopper into said interior chamber of said auger housing and towards and out of said discharge outlet of said auger housing and into said casing; removing said casing from said apparatus; and closing said opening of said casing via said closure means.

It is preferred that the apparatus include an externally threaded nozzle connected to said auger housing adjacent said discharge outlet. It is also preferable that said means for feeding stuffing from said interior chamber of said stuffing hopper into said interior chamber of said auger housing is a resilient bellows movable between a compressed configuration and an expanded configuration, received within said interior chamber of said stuffing hopper. Desirably, the apparatus further comprises a removable lid receivable over said inlet of said stuffing hopper. It is also advantageous that said drive means is a manually-operable handle.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
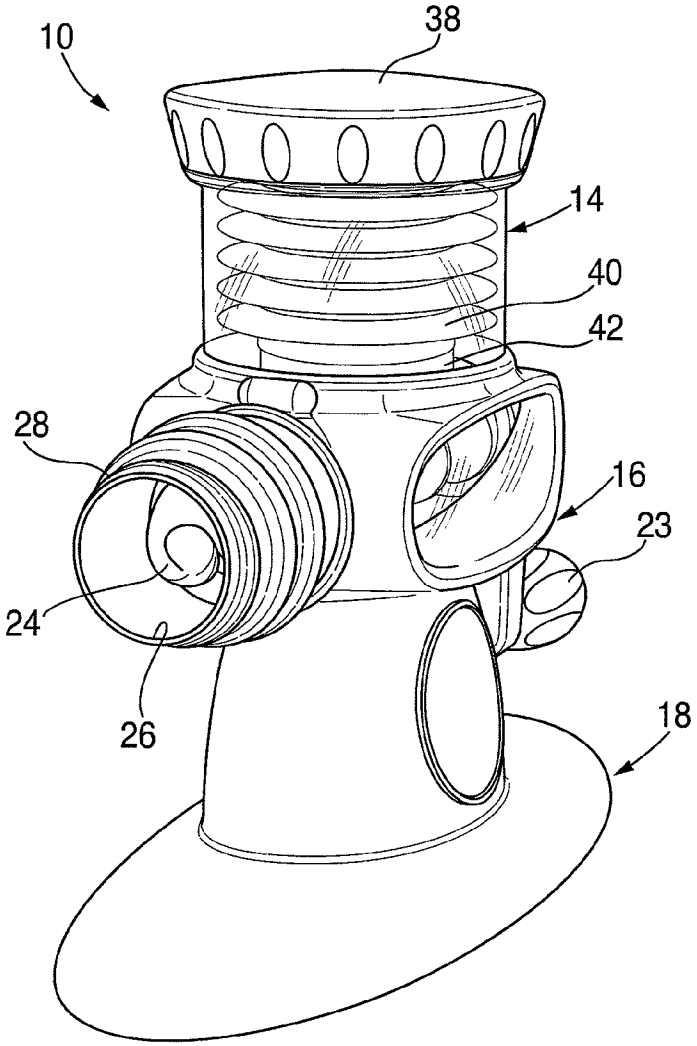
FIG. 1 is a perspective view of the toy stuffing apparatus, according to the present invention.
Figure 3:
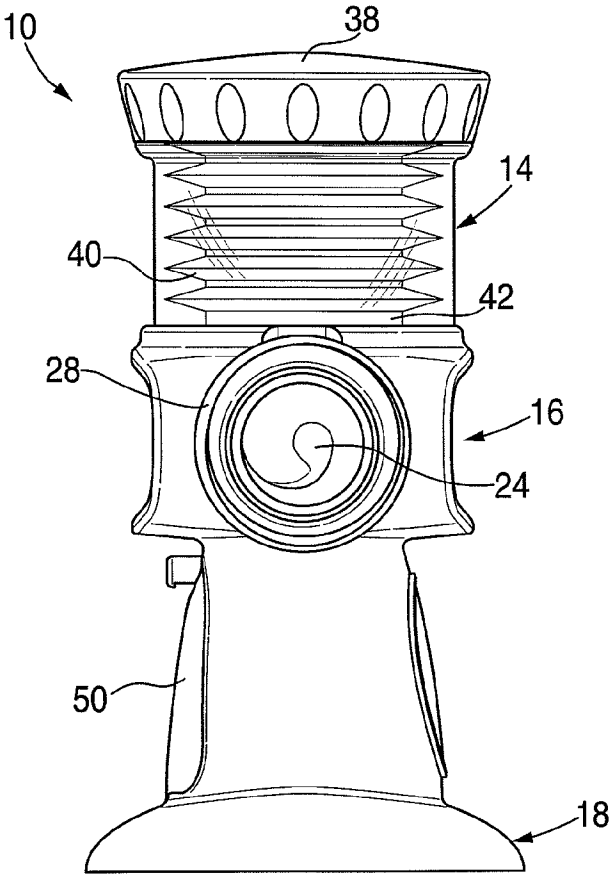
FIG. 3 is a front elevational view thereof.
Figure 2:
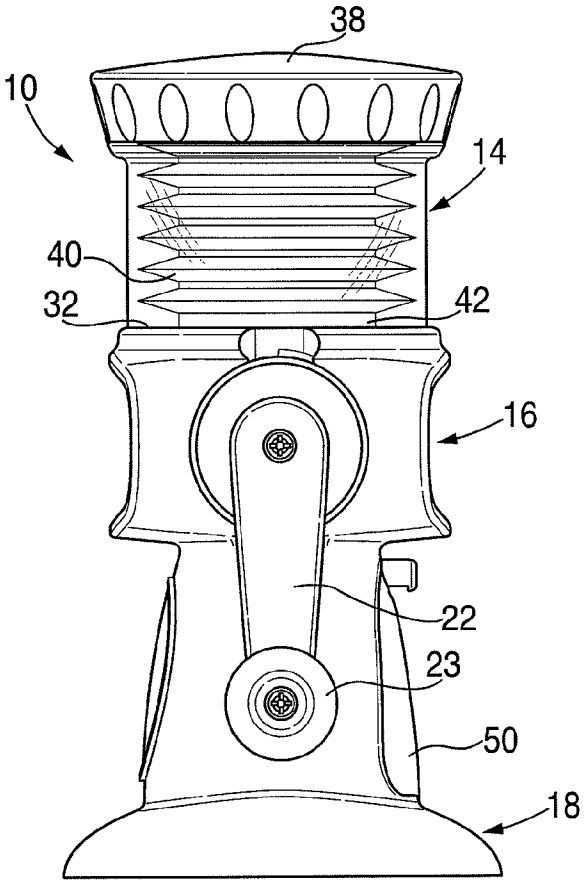
FIG. 2 is a rear elevational view thereof.
Figure 4:
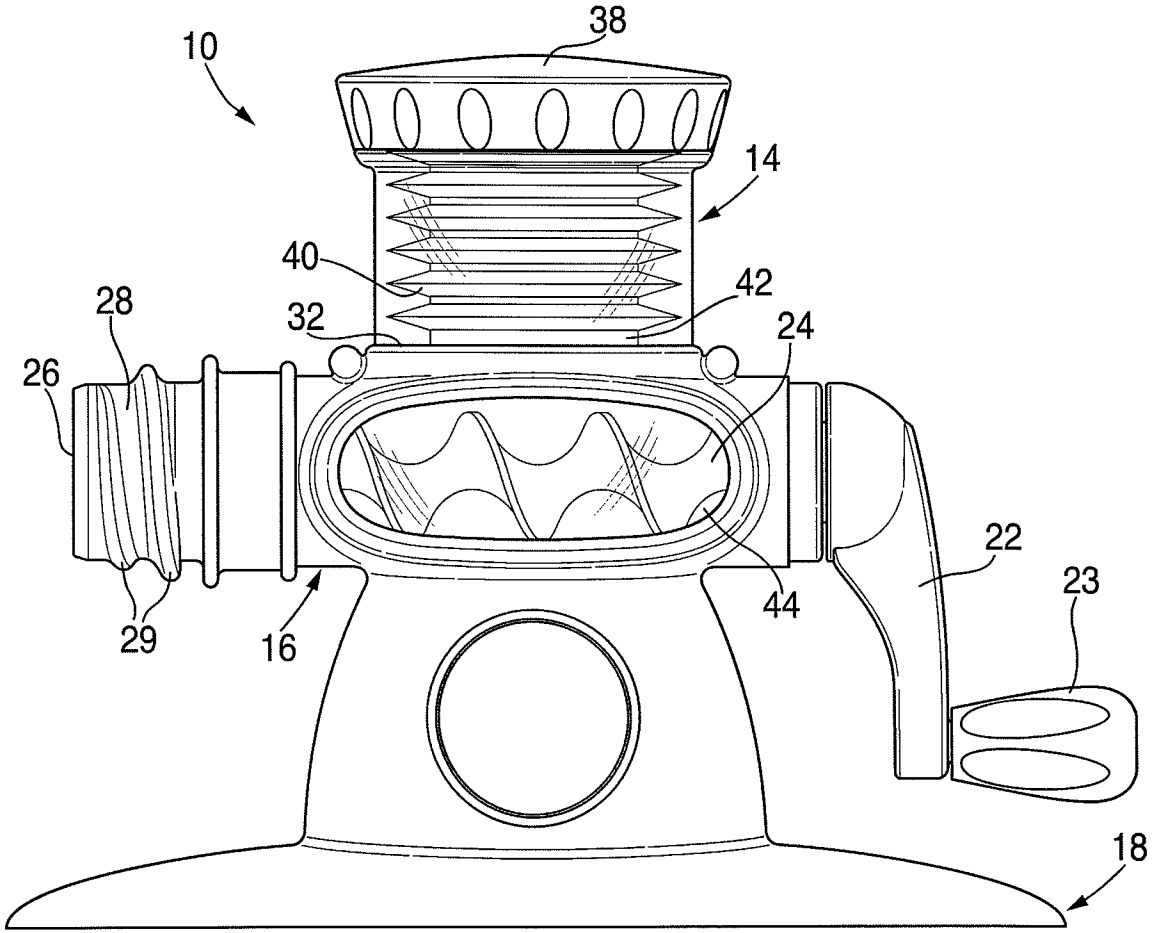
FIG. 4 is a right side elevational view thereof.
Figure 5:
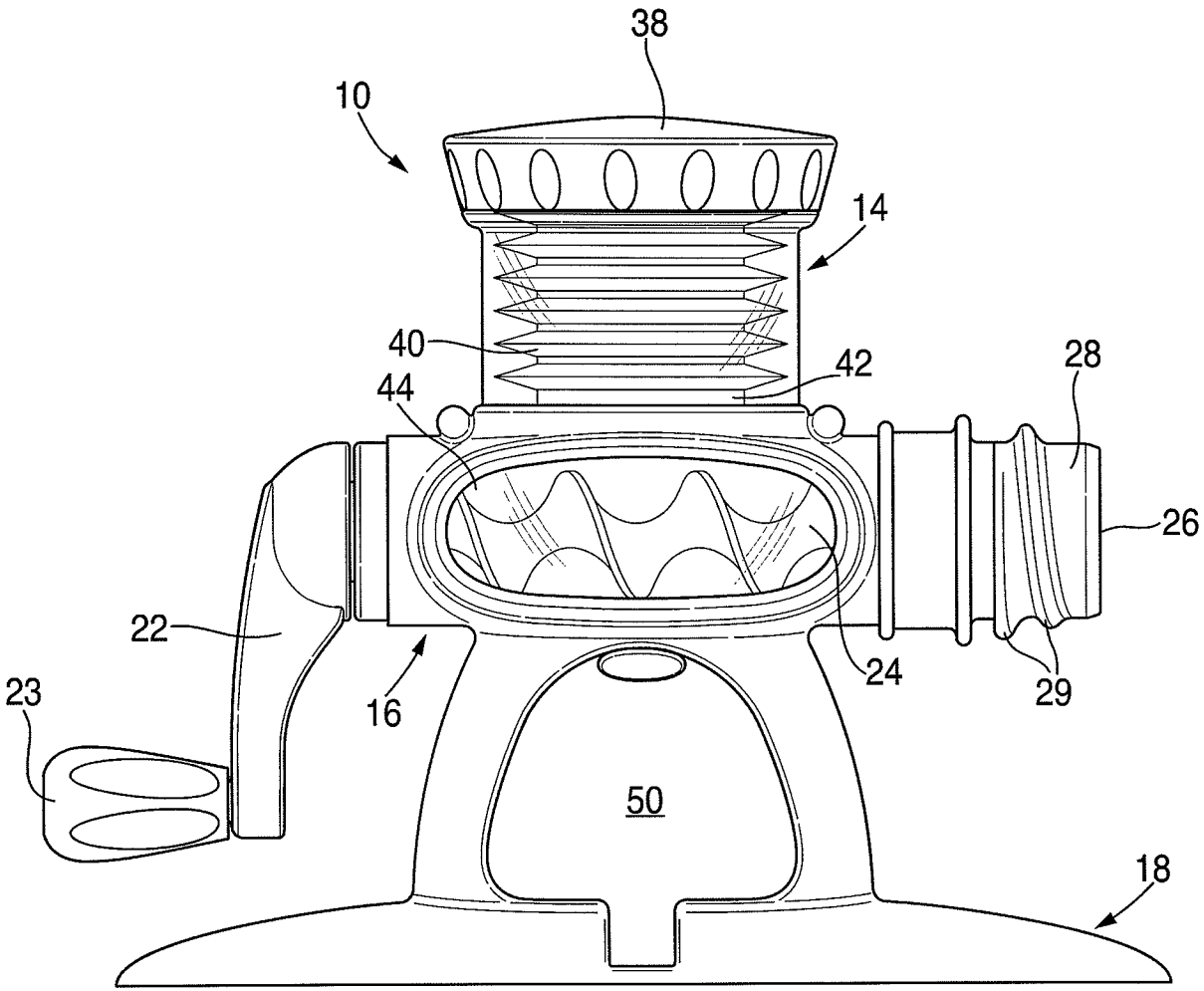
FIG. 5 is a left side elevational view thereof.
Figure 6:
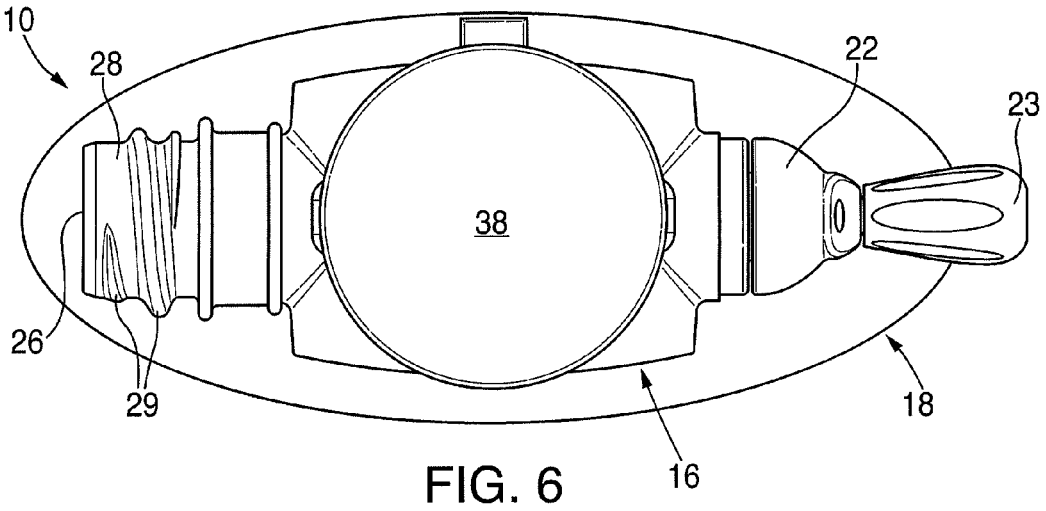
FIG. 6 is a top plan view thereof.
Figure 7:
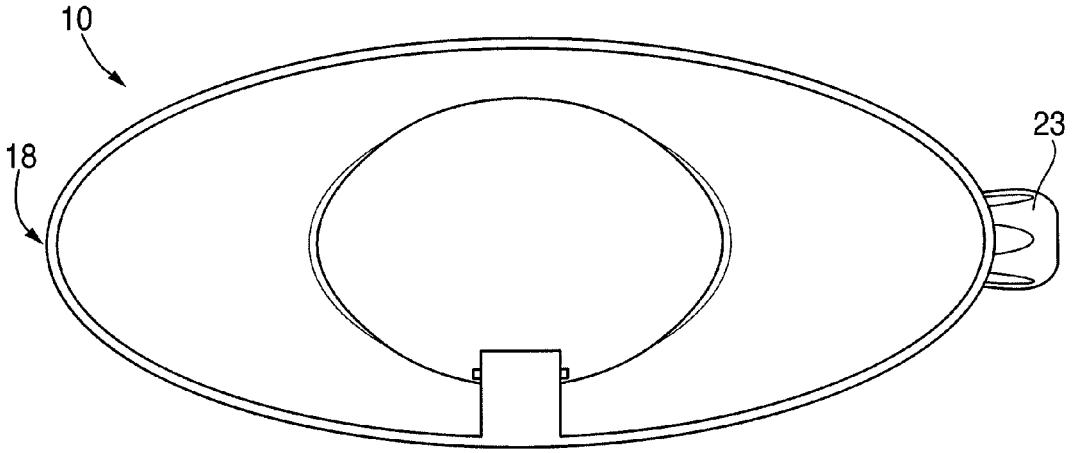
FIG. 7 is a bottom plan view thereof.

Turning now to FIG. 1, therein illustrated is the toy stuffing apparatus 10, according to the present invention. As seen in FIGS. 1 through 7, toy stuffing apparatus 10 comprises a housing consisting of an upper stuffing hopper 14, a middle auger housing 16, and a lower base 18, used to stuff plush toy casing 100.

Figure 8A:
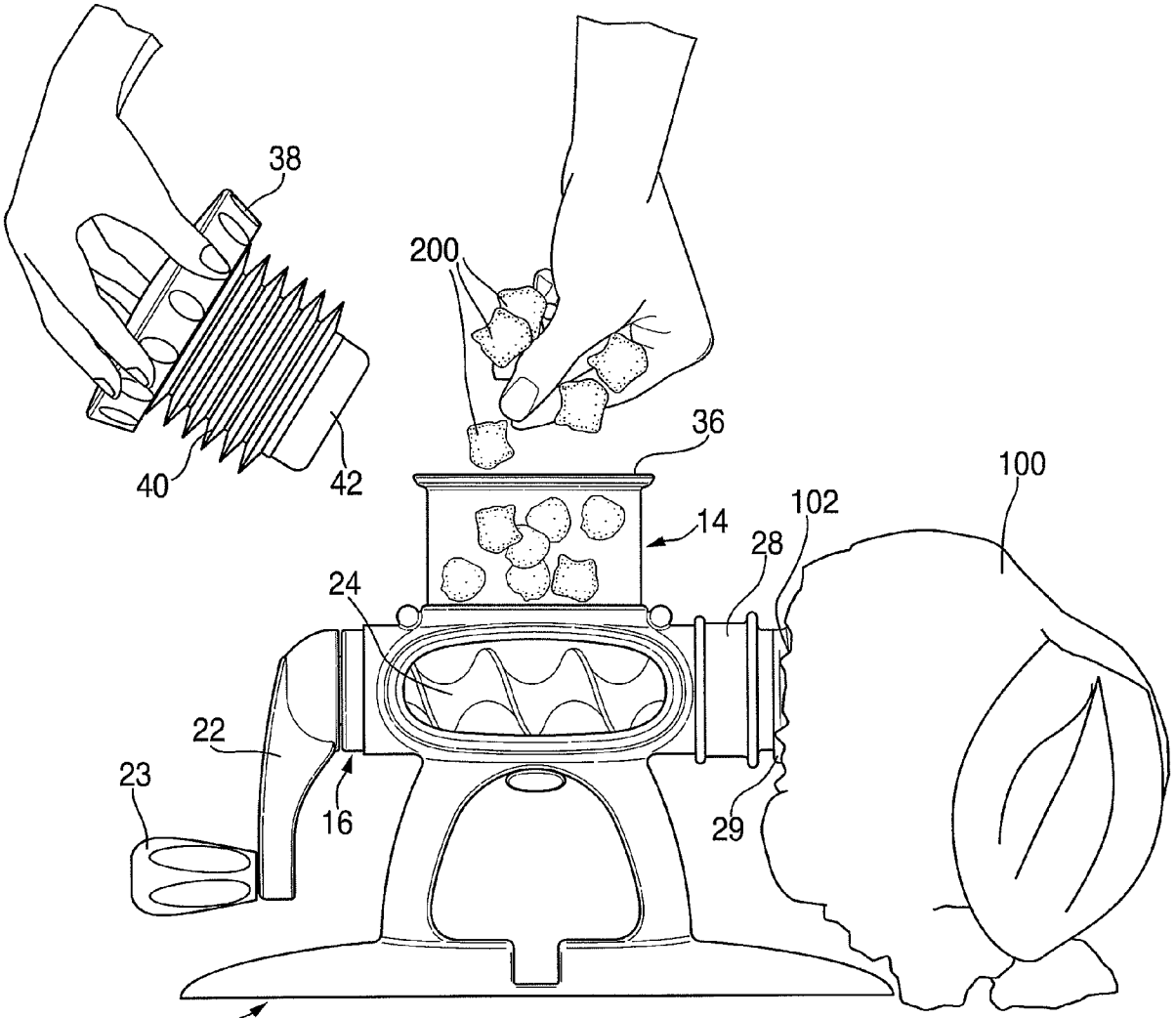
FIG. 8A is a left side elevational view of the toy stuffing apparatus, comparable to FIG. 5, but with a stuffed toy casing on the end thereof and with the bellows removed and stuffing being placed in the interior chamber of the stuffing hopper.

As can be seen in FIG. 8A, stuffing hopper 14 defines an interior chamber therein for receipt of stuffing 200 to subsequently be stuffed into plush toy casing 100. As seen in FIGS. 1-6 and 8A, stuffing hopper 14 has a cylindrical-shaped interior chamber and a stuffing inlet 36 on its open top end, through which the stuffing 200 is inserted. Stuffing hopper 14 also has a lower discharge outlet 32 opposite from the inlet 36, to allow stuffing 200 to exit stuffing hopper 14 into auger housing 16.

As also seen in FIGS. 1-6, a removable lid 38 is attachable to inlet 36 of stuffing hopper 14. A compressible, resilient bellows 40 is mounted on the underside of lid 38 and is removably receivable within the interior chamber of stuffing hopper 14. Bellows 40 is compressible into a non-expanded configuration (See, FIG. 8B) and expandable into an open and expanded configuration (See, FIG. 8A). Particularly, bellows 40 is made of a resilient material which biases the bellows 40 to its open and expanded configuration. Preferably, bellows 40 includes a plunger 42 on its lower end thereof. As seen in FIG. 8A, lid 38, bellows 40 and plunger 42 can be removed from stuffing hopper 14 to provide access to the hollow interior chamber of stuffing hopper 14. This allows stuffing 200 to be placed within stuffing hopper 14 via the inlet 36.

It is preferred that bellows 40 has a diameter slightly less than the diameter of the cylindrically-shaped interior chamber of stuffing hopper 14, to allow for it to expand downwardly to its open and expanded configuration due to its resilient nature and, conversely, be resiliently compressed when in contact with stuffing 200. It is also preferred that plunger 42 has a diameter which is less than the diameter of bellows 40 and is tapered on its lower end thereof, to feed stuffing 200 downwardly in the interior chamber of stuffing hopper 14 and subsequently into auger housing 16.

Lid 38 is removably affixed to inlet 36 of stuffing hopper 14, such as by corresponding screw threads (not shown). However, other means to affix cap 38 can be utilized such as by a snap or press fit. As an alternative to the preferred embodiment, bellows 40 and lid 38 are separate unattached components.

Figure 8B:
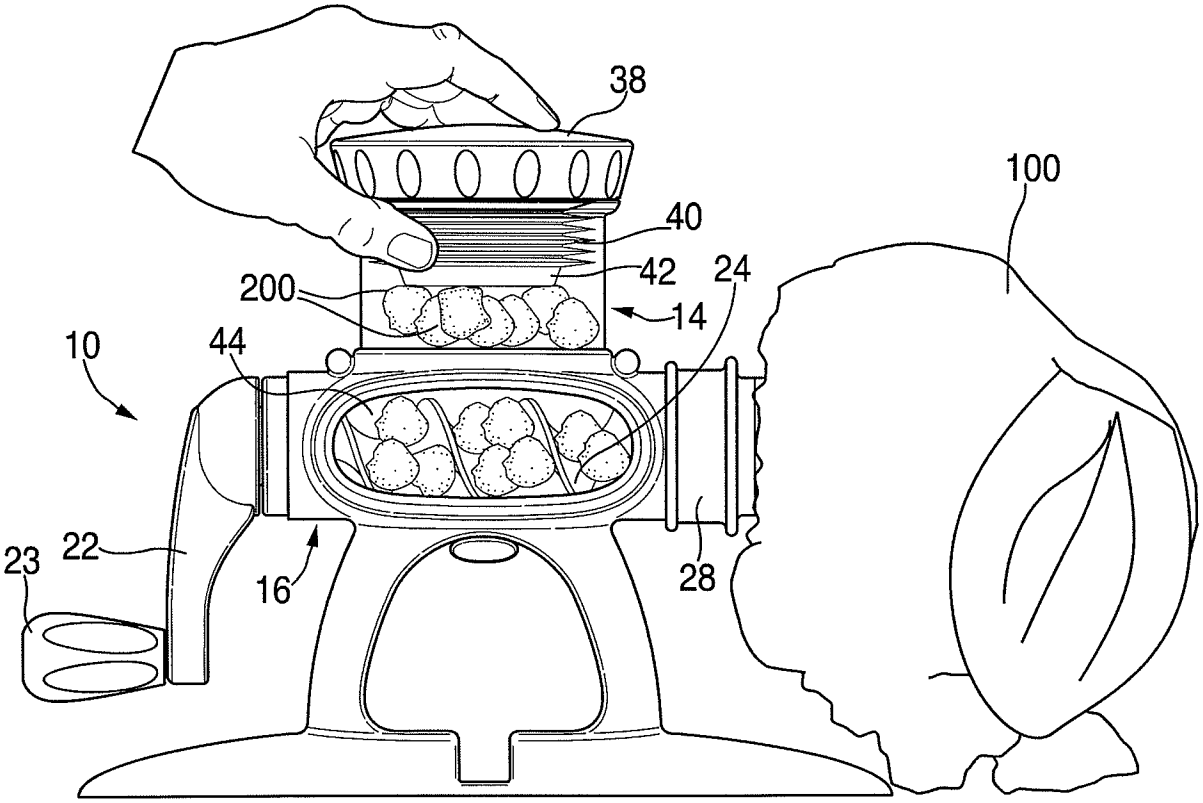
FIG. 8B is a left side elevational view comparable to FIG. 8A, but showing the bellows being placed in the interior chamber of the stuffing hopper atop the stuffing.

As seen in FIG. 8B, after stuffing 200 is placed within the interior chamber of stuffing hopper 14, bellows 40 and plunger 42 can then be placed within the interior chamber of stuffing hopper 14, on top of stuffing 200. Bellows 40 is compressed due to stuffing 200 within stuffing hopper 14 and biasely exerts a downward pressure on stuffing 200 via plunger 42, as a result of its resiliency, to force stuffing 200 into auger housing 16. Preferably, stuffing hopper 14 is made of a transparent material, such as clear plastic so that bellows 40, plunger 42 and stuffing 200 are visible through stuffing hopper 14. This provides added visual interest to the users, and in particular, children, who can view stuffing 200 through stuffing hopper 14.

As can also be seen in FIGS. 1-6, auger housing 16 is located beneath stuffing hopper 14. Auger housing 16 also defines an interior chamber therein which is in communication with the interior chamber of stuffing hopper 14. Particularly, the interior chamber of auger housing 16 has an inlet located adjacent to outlet 32 of stuffing hopper 14, and a discharge outlet 26. In use, stuffing 200 is fed downwardly from outlet 32 of stuffing hopper 14, into the inlet of auger housing 16 through pressure exerted from bellows 40 via plunger 42 (see, FIGS. 8B and 8C). Preferably, the inlet of the interior chamber of auger housing 16 has a funnel-shaped, downwardly-tapered configuration (not shown), which is not too steep to feed the stuffing 200 from discharge outlet 32 of stuffing hopper 14 too quickly but not too shallow to cause the stuffing 200 to bind or collect in the interior chamber of auger housing 16.

Auger housing 16 also encloses a corkscrew-like, rotatable auger 24. Auger 24 is centrally positioned within the interior chamber of auger housing 16 in order to, when rotated, move stuffing 200 in the interior chamber of auger housing 16, towards discharge outlet 26 and, subsequently, into toy casing 100, as shown in FIG. 8C.

Auger 24 is attached to drive means for rotating auger 24. As seen in FIGS. 1-6, the drive means is a handle 22 which can be manually rotated. Preferably, the end of handle 22 has a knob 23, so that handle 22 is easier to grip by the user, and in particular children. As handle 22 is turned, auger 24 is also rotated. As seen in FIG. 8C, the rotation of auger 24 allows for stuffing 200 to be moved through the interior chamber of auger housing 16 towards discharge outlet 26. It will be understood, however, that alternate drive means for rotating auger 24 will be obvious to one skilled in the art, such as by a motor and the necessary electronic circuitry to connect the motor to the power source and operating controls.

In the preferred embodiment, auger housing 16 also includes a nozzle 28, as seen in FIGS. 1 and 3-6. Nozzle 28 is preferably tapered on its outer end and has external screw threads 29. However, other suitable nozzle configurations and shapes can be utilized, such as one having an arrow shape or one having a larger-sized outer end and a narrower inner neck portion, to allow the casing 100 to be placed over the larger end and held to the narrower neck in order to prevent the casing from easily coming off during stuffing.

Figure 8C:
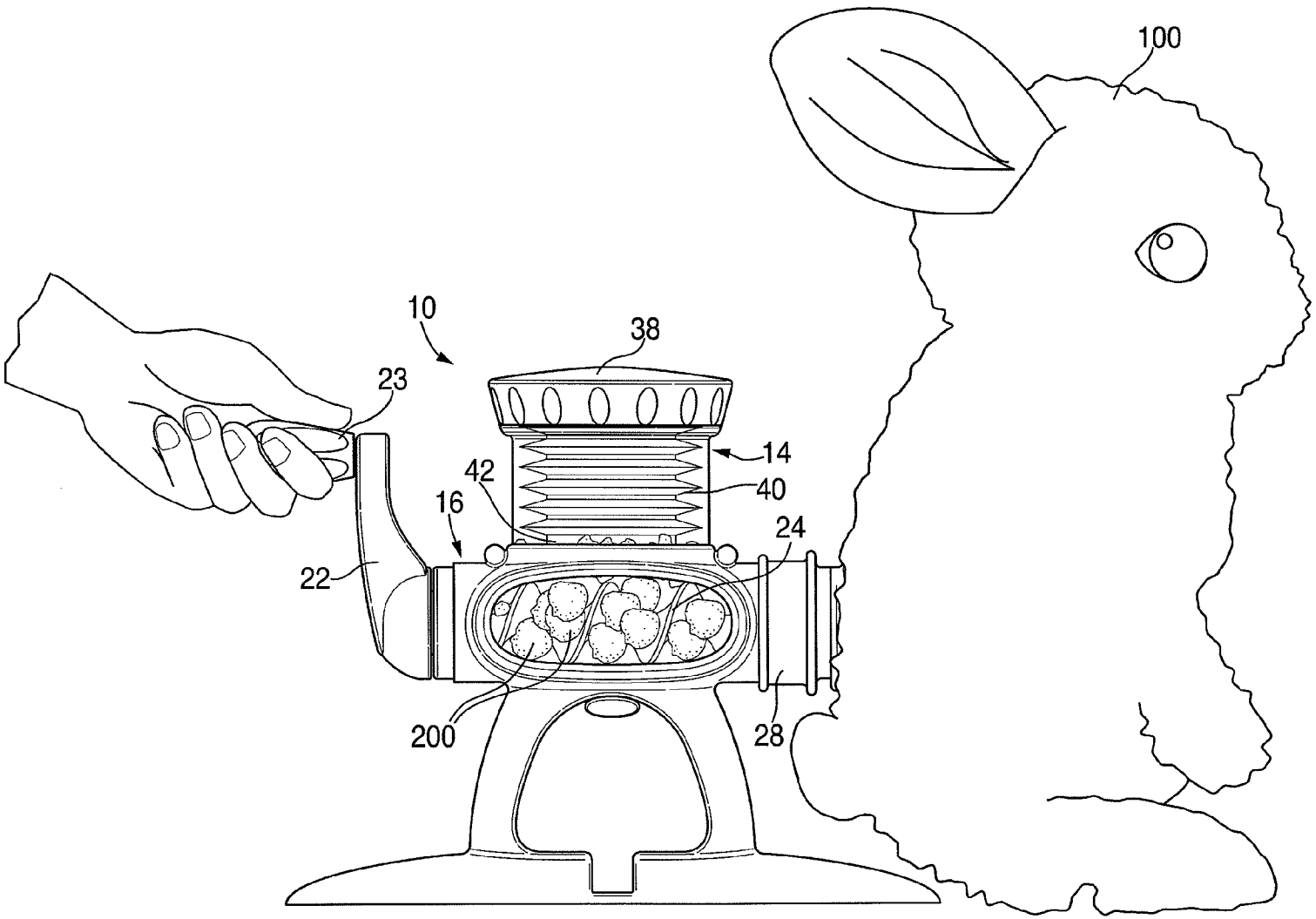
FIG. 8C is a left side elevational view comparable to FIG. 8B, but showing a user cranking the handle to rotate the auger and, in turn, stuff the plush toy casing.

As can be seen in FIGS. 8A-8C, plush toy casing 100 is removably affixed to nozzle 28 to allow for casing 100 to be filled by stuffing 200 exiting apparatus 10. The optional provision of external threads 29 on the outside of nozzle 28 allows for the user to screw casing 100, here in the shape of a rabbit, onto nozzle 28 so that it can be securely, yet removably, affixed thereto and does not have to be held in place by the user. This allows the user to have both hands free while using apparatus 10 to stuff casing 100. This is beneficial when the device is used by small children who can hold the apparatus 10 with one hand and turn handle 22 with the other hand. Alternatively, other means to manually secure casing 100 to nozzle 28 can be utilized.

As seen best in FIGS. 4-5 and 8A-8C, it is also preferable that auger housing 16 include windows 44, which are made of a transparent material such as clear plastic. This allows the user to view auger 24 and stuffing 200 through windows 44 and provides added visual interest since the user can see the auger 24 being turned and stuffing 200 moving towards the stuffing exit 26. The location, number and size of windows 44 can vary.

Other elements of the main embodiment can be seen in FIGS. 1 through 7. Base 18 can include a storage compartment 50 in which decorative accessories may be stored. Additionally, apparatus 10 may further comprise a battery housing (not shown) which contains circuitry and batteries (not shown), which powers elements, such as lights, for example, LED's or a sound chip (not shown), to provide further entertainment. The electronic circuitry necessary to connect these elements to the power source would be well known to a person having ordinary skill in the art.

Therefore in use, as seen in FIGS. 8A-8C, plush toy casing 100, here in the shape of a rabbit having an opening 102, is placed over and mounted on nozzle 28. Particularly, opening 102 is placed over the outermost thread 29 and casing 100 is turned onto external threads 29 of nozzle 28 so that it is securely yet removably affixed thereto and so that a portion of nozzle 28 is received within casing 100. As shown in FIG. 8A, lid 38 and, in turn, bellows 40 and plunger 42 are removed from the interior chamber of stuffing hopper 14. Stuffing 200 is placed via inlet 36 into the interior chamber of stuffing hopper 14. As seen in FIG. 8B, bellows 40 and plunger 42 are then placed back into the interior chamber of stuffing hopper 14, atop the stuffing 200, and bellows 40 are compressed due to the stuffing 200 now within stuffing housing 14. The cap 38 is then screwed onto stuffing hopper 14 to seal inlet 36 of stuffing hopper 14.

As can be seen in FIGS. 8B-8C, bellows 40, due to its resiliency, continuously forces stuffing 200 downwardly in the interior chamber of stuffing hopper 14 toward the stuffing outlet 32 of stuffing hopper 14 and, subsequently, into auger housing 16. As shown in FIG. 8C, handle 22 is turned, rotating auger 24. Auger 24 drives stuffing 200 through auger housing 16, and out of outlet 26, and in turn, into casing 100. Once fully stuffed, stuffing casing 100 is removed from nozzle 28 and opening 102 is closed via means for fastening such as by stitching, buttons, zipper, laces, etc. (not shown).

While there have been shown and described novel features of the invention as applied to a preferred embodiment thereof, it will be understood that various omissions and substitutions and changes in the form and details of the method steps described, the devices illustrated, and the operation thereof, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

Particularly, while the stuffed toy casing has been illustrated in the shape of a rabbit, it can assume any other shape such as, for example a teddy bear or dog. Moreover, although the window and stuffing hopper have been illustrated as being transparent, they can be fully or partially transparent or opaque. Additionally, the number and location of the windows can be altered. Furthermore, the shape of the nozzle can be modified and the device may include other mechanical means for securing the casing to the nozzle.

The invention claimed is:

1. An apparatus for inserting stuffing into a casing, comprising:

a stuffing hopper defining an interior chamber therein, having an inlet for receiving stuffing and an outlet for discharging stuffing;

an auger housing located below said stuffing hopper and defining an interior chamber therein, which is in communication with said interior chamber of said stuffing hopper, said auger housing having an inlet located adjacent to and in communication with said outlet of said stuffing hopper, and a discharge outlet to discharge the stuffing from said apparatus;

means for feeding stuffing from said interior chamber of said stuffing hopper into said interior chamber of said auger housing, which means are located within said stuffing hopper;

a rotatable auger located within said interior chamber of said auger housing to drive the stuffing in said interior chamber of said auger housing towards and to said discharge outlet thereof, where it, in turn, exits said auger housing into the casing; and drive means for rotating said auger;

wherein said means for feeding stuffing from said interior chamber of said stuffing hopper into said interior chamber of said auger housing is a resilient bellows movable between a compressed configuration and an expanded configuration, received within said interior chamber of said stuffing hopper.

2. The apparatus according to claim 1, further comprising:

an externally threaded nozzle connected to said auger housing adjacent said discharge outlet.

3. The apparatus according to claim 1, wherein:

at least one of said stuffing hopper and said auger housing includes a transparent portion.

4. The apparatus according to claim 3, wherein:

said stuffing hopper is transparent.

5. The apparatus according to claim 3, further comprising:

at least one transparent window in said auger housing.

6. The apparatus according to claim 1, further comprising:

a removable lid receivable over said inlet of said stuffing hopper.

7. The apparatus according to claim 1, wherein:

said drive means is a manually-operable handle.

8. A kit for making a stuffed toy at home, comprising:

a casing having an opening therein;

stuffing to be inserted into said casing;

closure means for closing said opening in said casing; and an apparatus for inserting stuffing into said casing, comprising a stuffing hopper defining an interior chamber therein, having an inlet for receiving said stuffing and an outlet for discharging said stuffing; an auger housing located below said stuffing hopper and defining an interior chamber therein, which is in communication with said interior chamber of said stuffing hopper, said auger housing having an inlet located adjacent to and in communication with said outlet of said stuffing hopper, and a discharge outlet to discharge said stuffing from said apparatus; means for feeding said stuffing from said interior chamber of said stuffing hopper into said interior chamber of said auger housing, which means are located within said stuffing hopper; a rotatable auger located within said interior chamber of said auger housing to drive said stuffing in said interior chamber of said auger housing towards and to said discharge outlet thereof, where it, in turn, exits said auger housing into said casing and drive means for rotating said auger;

wherein said means for feeding stuffing from said interior chamber of said stuffing hopper into said interior chamber of said auger housing is a resilient bellows movable between a compressed configuration and an expanded configuration, received within said interior chamber of said stuffing hopper.

9. The apparatus according to claim 8, further comprising:

an externally threaded nozzle connected to said auger housing adjacent said discharge outlet.

10. The apparatus according to claim 8, wherein:

at least one of said stuffing hopper and said auger housing includes a transparent portion.

11. The apparatus according to claim 8, further comprising:

a removable lid receivable over said inlet of said stuffing hopper.

12. The apparatus according to claim 8, wherein:

said drive means is a manually-operable handle.

13. A method for making a stuffed toy comprising:

a) providing a casing having an opening therein, stuffing to be inserted into said casing, closure means for closing said opening in said casing and an apparatus for inserting stuffing into said casing, comprising a stuffing hopper defining an interior chamber therein, having with an inlet for receiving said stuffing and an outlet for discharging said stuffing; an auger housing located below said stuffing hopper and defining an interior chamber therein, which is in communication with said interior chamber of said stuffing hopper, said auger housing having an inlet located adjacent to and in communication with said outlet of said stuffing hopper, and a discharge outlet to discharge said stuffing from said apparatus; means for feeding said stuffing from said interior chamber of said stuffing hopper into said interior chamber of said auger housing, which means are located within said stuffing hopper; a rotatable auger located within said interior chamber of said auger housing to drive said stuffing in said interior chamber of said auger housing towards and to said discharge outlet thereof, where it, in turn, exits said auger housing into said casing; and drive means for rotating said auger;

b) removing said means for feeding said stuffing from said interior chamber of said stuffing hopper into said interior chamber of said auger housing, from said stuffing hopper;

c) inserting said stuffing into said interior chamber of said stuffing hopper;

d) placing said means for feeding said stuffing from said interior chamber of said stuffing hopper into said interior chamber of said auger housing into said stuffing housing;

e) affixing said opening of casing onto said discharge outlet of said auger housing;

f) rotating said drive means to, in turn, rotate said auger, to feed said stuffing from said interior chamber of said stuffing hopper into said interior chamber of said auger housing and towards and out of said discharge outlet of said auger housing and into said casing;

g) removing said casing from said apparatus; and h) closing said opening of said casing via said closure means.

14. The apparatus according to claim 13, further comprising:

an externally threaded nozzle connected to said auger housing adjacent said discharge outlet.

15. The apparatus according to claim 13, wherein:

said means for feeding stuffing from said interior chamber of said stuffing hopper into said interior chamber of said auger housing is a resilient bellows movable between a compressed configuration and an expanded configuration, received within said interior chamber of said stuffing hopper.

16. The apparatus according to claim 13, further comprising:

a removable lid receivable over said inlet of said stuffing hopper.

17. The apparatus according to claim 13, wherein:

said drive means is a manually-operable handle.

* * * * *